US008096308B2

(12) United States Patent
Ramos

(10) Patent No.: US 8,096,308 B2
(45) Date of Patent: Jan. 17, 2012

(54) COSMETIC PRODUCT DISTRIBUTION CASE

(75) Inventor: Victor Ramos, Rambouillet (FR)

(73) Assignee: Albea Services (FR)

( * ) Notice: Subject to any disclaimer, the term of this patent is extended or adjusted under 35 U.S.C. 154(b) by 369 days.

(21) Appl. No.: 12/424,645

(22) Filed: Apr. 16, 2009

(65) Prior Publication Data

US 2009/0260653 A1 Oct. 22, 2009

(30) Foreign Application Priority Data

Apr. 16, 2008 (FR) ..... 08 02100

(51) Int. Cl.
*A45D 40/24* (2006.01)

(52) U.S. Cl. ..... 132/294; 206/823; 132/314

(58) Field of Classification Search ..... 132/286–287, 132/290–291, 293–307; 206/736, 766; 220/525, 220/543, 547–549, 560, 23.86, 259.1, 288, 220/282, 815–816, 820, 522, 503, 213, 817; 446/233, 234, 238–240, 246, 266; 211/99, 211/111, 164–165

See application file for complete search history.

(56) References Cited

U.S. PATENT DOCUMENTS

| | | | | |
|---|---|---|---|---|
| 2,533,507 | A | 12/1950 | Risberg et al. | |
| 4,777,969 | A * | 10/1988 | Holloway | 132/314 |
| 2006/0081638 | A1 * | 4/2006 | Pavlos | 220/505 |

FOREIGN PATENT DOCUMENTS

| | | |
|---|---|---|
| DE | 535681 | 10/1931 |
| FR | 775787 | 1/1935 |
| FR | 2839865 | 11/2003 |

OTHER PUBLICATIONS

Search Report in corresponding French Application No. 0802100 dated Jul. 12, 2010.

* cited by examiner

*Primary Examiner* — Todd Manahan
*Assistant Examiner* — Brianne O'Neill
(74) *Attorney, Agent, or Firm* — Banner & Witcoff, Ltd.

(57) ABSTRACT

The case (1) for cosmetic products, typically in the form of paste or compact powder cakes, comprises a hollow base (2, 3) having an upper opening (16), a cover (15) closing said upper opening and a support (4) arranged inside said hollow base, said support comprising at least a first support surface (7) and a second support surface (8), the first and second support surfaces each comprising at least one compartment (10) intended to receive a cosmetic product (9), is characterized in that the support cooperates in a mobile manner with said hollow base so that the support can be turned inside the hollow base to present said first support surface or said second support surface through the upper opening.

16 Claims, 7 Drawing Sheets

COSMETIC PRODUCT DISTRIBUTION CASE

FIELD OF INVENTION

The invention concerns the field of packaging and presentation of makeup or cosmetic products typically in powder form, and more particularly the field of cases comprising cosmetic products and application means.

BACKGROUND OF RELATED ART

Cases with essentially plane internal grilles are known which define spaces in which cosmetic products and brush type applicators are arranged flat. Cases comprising several superimposed grilles are also known that are designed to increase the number of different products in the same case. The products contained are particularly in paste or compact powder format, for example lipstick, eye shadow, gloss, and colours.

In patent application US2008/023023, for example, a cosmetics compact is known in which the cosmetic products are arranged on two opposite surfaces of a same support, this support being able to turn on itself inside a frame after extraction of the support and from this frame inside a hollow base in which they are arranged.

PROBLEMS POSED

According to the state of the art, several types of problems are posed by the powder application means:

- such cases are generally flat with significant longitudinal and lateral dimensions, and of thin thickness so that they are habitually arranged flat in the bathroom and require significant storage space;
- the handling operations required to swap the various grilles in order to access all the products of the case can prove to be difficult and dirty, for example if an upper grille is raised to gain access to a lower grille, this involves using one hand to hold the upper grille between at least the thumb and another finger and also requires an additional space on which this upper grille can be placed, or if an upper grille rotates about a hinge, the products upside down, for example of compact powder type, may release product outside the case or into a cover of the case;
- the space in which the application means are arranged can become dirty and dirty the gripping means of these application means;
- finally, in the field of makeup in particular, it is important to regularly renew the commercial offer of products, as novelty most often prevails over tradition in the mind of the buyer.

DESCRIPTION OF THE INVENTION

The invention proposes to solve the problems exposed above by means of a case for cosmetic products, typically in the form of paste or compact powder cakes, comprising a hollow base having an upper opening, and a support placed inside said hollow base, said support comprising at least one support surface comprising at least one compartment intended to receive a cosmetic product, characterised in that the support cooperates in a mobile manner with said hollow base so that the support can be turned inside the hollow base to present said support surface through the upper opening.

According to a preferred embodiment of the invention, the case comprises at least a first support surface and a second support surface, said first and second support surfaces each comprising at least one compartment designed to receive a cosmetic product, and the support cooperates in a mobile manner with said hollow base so that the support can be turned inside the hollow base to present said first support surface or said second support surface through the upper opening.

Preferably, the support comprises two essentially opposite support surfaces, that is when one of these surfaces faces upward, the other surface faces downward, and inversely, so that when the support inside the hollow base is turned to present, through the upper surface, said first support surface or said second support surface returns to perform a 180° turn of the support. The hollow base has a sufficient depth to allow the support to turn without it first being necessary to extract this support from the hollow base. Also, handling the case and the case support is simple and the applicator(s) can be placed in the direction of the height, that is vertically, inside a recess formed in the support. Consequently, the risks of dirtying oneself by handling the support or by grasping an applicator are reduced. The possible soiling caused by turning the support and cosmetic products over are localised inside the hollow base and do not spread outside the case.

According to various advantageous embodiments of the invention:

- the hollow base features a gripping means, and a mobile drive means in relation to the gripping means, and the support is turned inside the hollow base by manual movement of said drive means in relation to said gripping means; it is thus not necessary to touch the support to turn it over, which, in addition to the practical and innovative aspect, further limits the risks of soiling;
- said gripping means, said drive means and said support cooperate by forming a gearing system capable of driving the support in rotation inside the hollow base by manual displacement of said drive means in relation to said gripping means;
- the gearing system is of rack-and-pinion type;
- a part of the support forms a pinion, and, a part of the drive means forms a rack and/or a part of the gripping means forms a rack;
- the support rotates about an axis fixed in relation to said drive means or said gripping means, for example in the case where a single element among the drive means and the gripping means comprises a rack, the other element forming a fixed seat to maintain the axis fixed;
- the support turns about an axis that is mobile in relation to said drive means and to said gripping means, for example in the case where the pinion is placed between two racks having an opposite relative movement;
- the gripping means has a circular bowl shape, the drive means has a circular collar shape, and the support is turned by rotation of the drive means in relation to the gripping means;
- the support turns 180° during one rotation of the drive means in relation to the gripping means between 30° and 100° and preferably during a rotation of 60°;
- at least one support surface features a recess intended to receive at least one applicator comprising a means for applying cosmetic products on a part of the body of the user, this recess preferably extending essentially perpendicularly to the support surface;
- a cover closing said upper opening.

According to another particular embodiment according to the invention, the support features a number of n support surfaces and the support cooperates in a mobile manner with said hollow base so that the support can be turned inside the hollow base to present a single support surface among the n support surfaces through the upper opening.

According to yet another particular embodiment according to the invention, the support comprises a surface serving as a cover and the support cooperates in a mobile manner with said hollow base so that the support can be turned inside the hollow base to present a single support surface or said surface serving as a cover through the upper opening.

The invention shall be better understood upon reading the following description and by studying the accompanying figures. This description is given for the purpose of illustration and is not to be taken as limiting in any way.

DETAILED DESCRIPTION OF THE INVENTION

Figure 1:
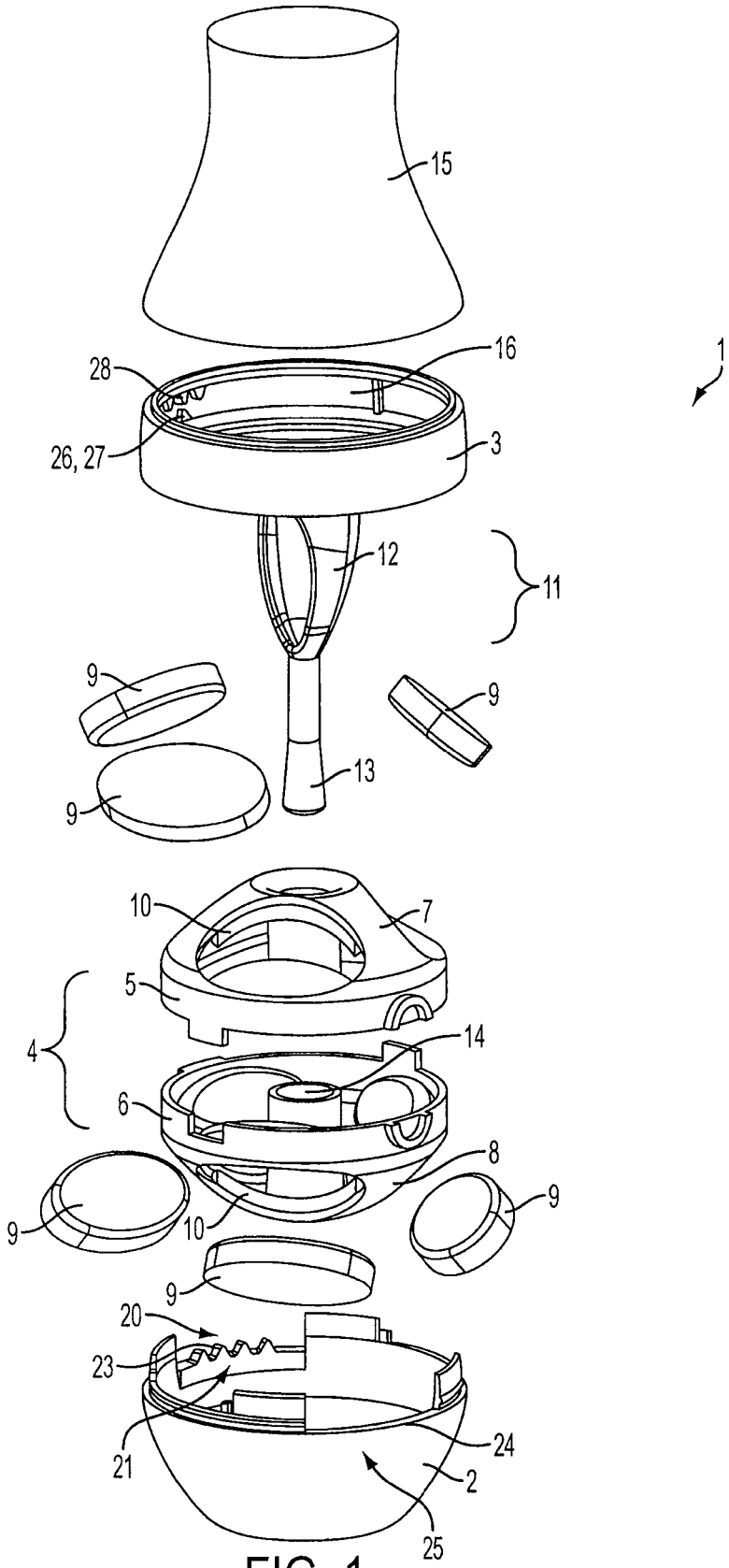
FIG. 1 is an exploded view drawing of an embodiment of a case according to the invention.

Figures present a particular embodiment of a case according to the invention. FIG. 1 shows an exploded view drawing of all the component parts of the case 1. This case 1 is comprised of:

- a hollow base, featuring a hollow bottom 2 in the shape of a circular flat-bottom bowl and a flange 3 in the shape of a circular collar;
- a support 4 for cosmetic products, comprise of a first part 5 and a second part 6 presenting respectively a first support surface 7 and a second support surface 8 opposite the first support surface 7;
- cosmetic products 9 in the form of paste or compact powder cakes intended to be arranged inside compartments 10 formed in the first and second support surfaces 7, 8;
- a cosmetic product applicator 11 comprising a handle 12 and an application means 13, typically of brush or foam type, this applicator 11 being designed to be placed inside a recess 14 passing through the support 4; and
- a cover 15 intended to close an upper opening 16 formed in the hollow base and more particularly in the flange 3.

Figure 3:
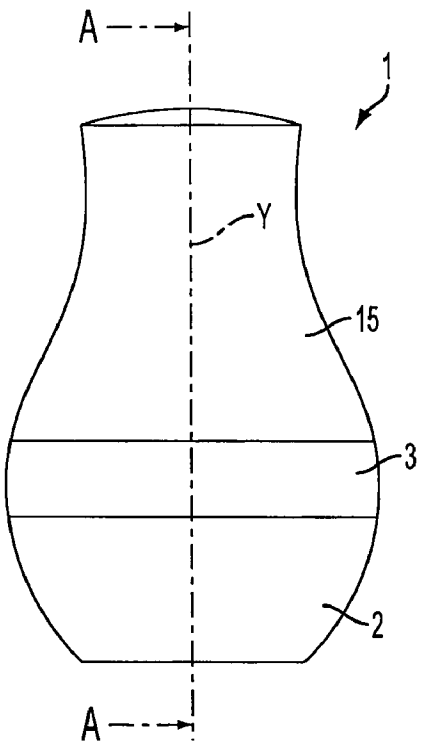
FIG. 3 is a side view of the case of FIG. 1 in closed position.
Figure 2:
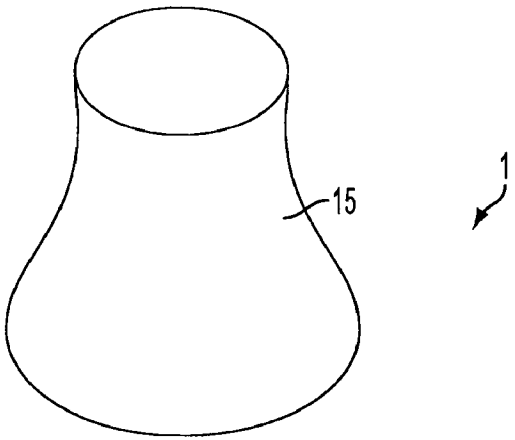
FIG. 2 is a perspective view of the case of FIG. 1 in open position.
Figure 2:
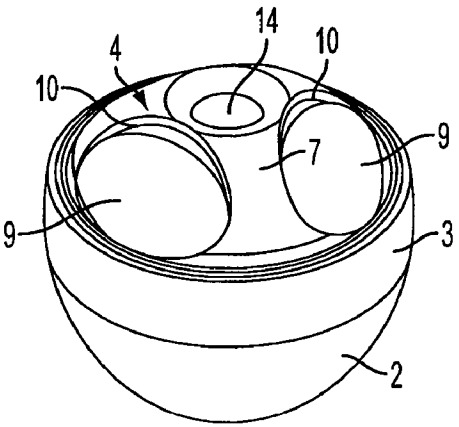

As is visible in FIG. 2 which shows the case 1 in open position, that is with the cover 15 freeing the upper opening 16, when the component parts of the case 1 are assembled, the support 4 is located inside the hollow base 2, 3. To close the case 1, as shown in FIG. 3, the cover 15 can be clipped, screwed or simply placed on the upper edge of the flange 3. The shape of this case 1 can, for example, be similar to that presented in the drawing and model U.S. Pat. No. 519,376 with, in a profile view, a lower flat-bottom rounded part and an upper elongated part in the form of a tube. The cover 15 is particularly made of a transparent plastic material so that it is possible to distinguish, through this cover, the elements arranged in the inner volume formed by the hollow base and the cover 15.

In FIG. 2, the case 1 presents, for example through the upper opening 16, the first support surface 7 comprising a plurality of compartments 10 for cosmetic products 9, for example 3. The support 4 cooperates with the hollow base such that the support can be turned inside the hollow base to present, through the upper opening, the second support surface 8 also comprising a plurality of compartments for cosmetic products, for example 3. To do this, the support can particularly turn 180° about an X-axis located between the first and second support surface. This X-axis extends inside the hollow base and more particularly between a pinion 17 and a ring 18, or nipple, formed between the two support surfaces 7, 8 and protruding at two opposite ends of the support 4. The two parts 5, 6 of the support are assembled, by bonding for example, to form the support 4 and these parts 5, 6 advantageously feature foolproofing keys 19 so that the pinion 17 and the ring 18 are correctly formed.

The flange 3 is coaxially mounted with the Y-axis on the bottom 2 in order to slide in rotation about the Y-axis in relation with the bottom, for example by clipping the circular flange on the upper circular edge of the bottom 2. The support 4 is particularly turned about the X-axis by rotation of the flange 3 about the Y-axis in relation to the bottom 2.

When the case 1 is used, in order to turn the support to access the cosmetic products arranged on the support surface not accessible through the upper opening, the user grasps the bottom 2 with one hand, and grasps the flange 3 with two fingers of the other hand in order to manually rotates the flange in relation to the bottom (and reciprocally obviously). In the case 1, it can be considered, owing to their respective sizes, that the bottom 2 is the gripping means of the case 1 and the flange 3 is a means to drive or move the support 4.

A gearing system connects the bottom 2, the flange 3 and the support 4 such that moving the flange 3 in relation to the bottom 2 drives the support 4 in rotation about an X-axis extending inside the hollow base and more particularly in a plane perpendicular to the Y-axis (or even parallel to the plane of the upper opening 16). The gearing system is more particularly of rack-and-pinion type.

Figure 5:
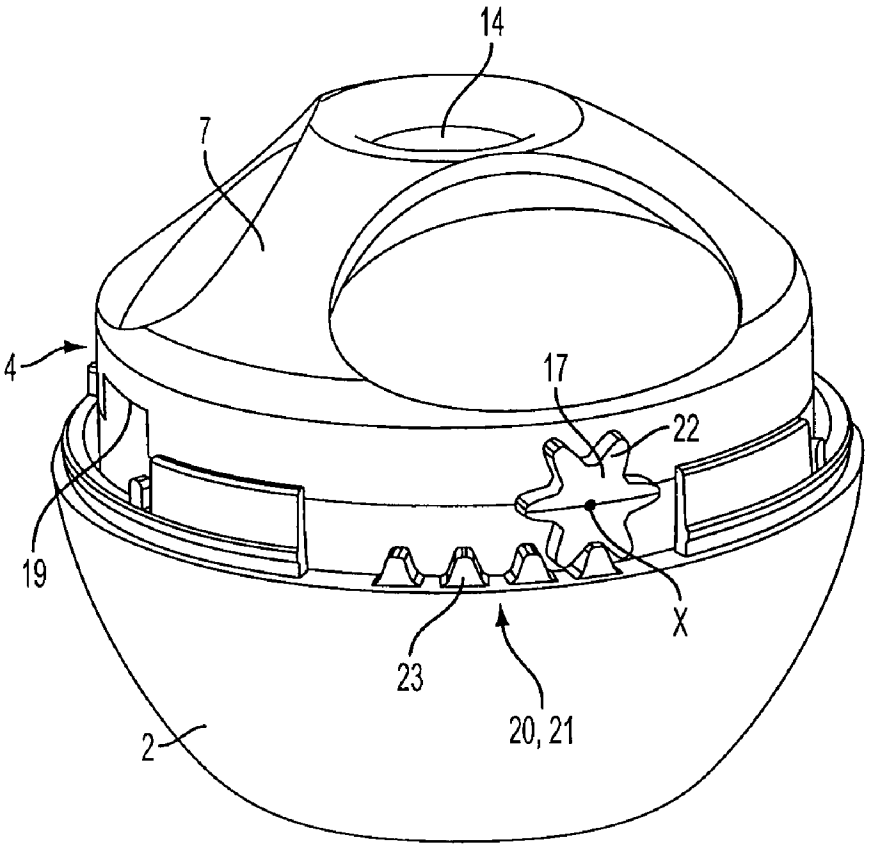
FIG. 5 is a perspective view of a part of the case.
Figure 6:
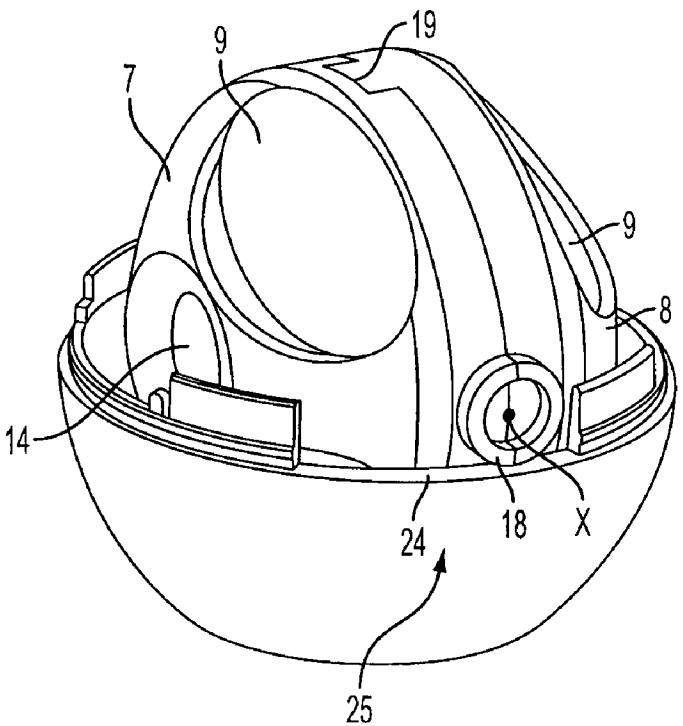
FIG. 6 is a perspective view of a part of the case.
Figure 8:
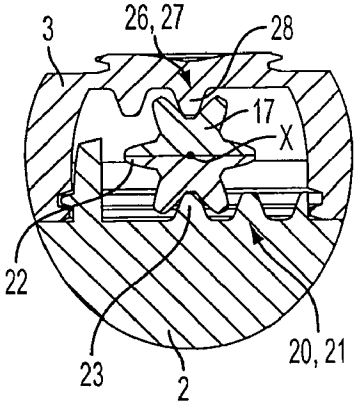
FIG. 8 is a cross sectional view of the case in FIG. 7.
Figure 9:
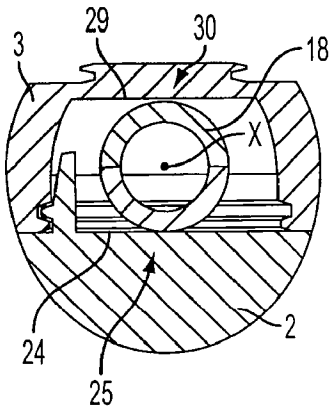
FIG. 9 is another cross sectional view of the case in FIG. 7.
Figure 7:
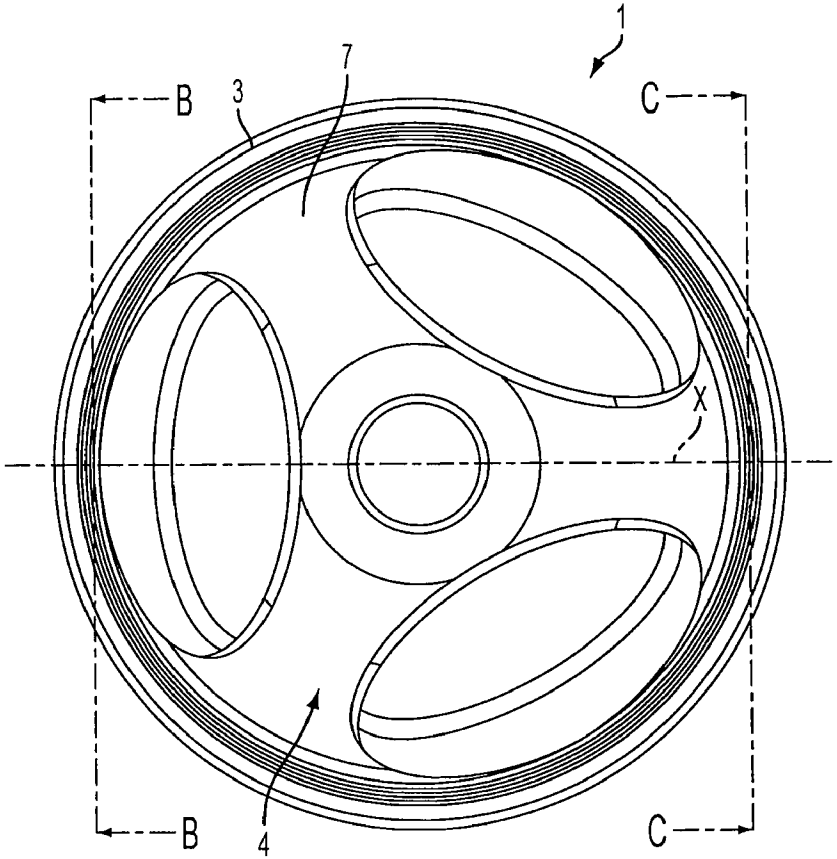
FIG. 7 is a top view of the case of FIG. 1 in open position.
Figure 10A:
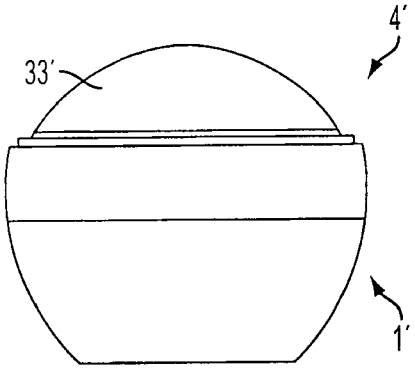
FIGS. 10A to 10C and FIGS. 10D to 10F show another particular embodiment according to the invention in a side view and perspective view, respectively.
Figure 10B:
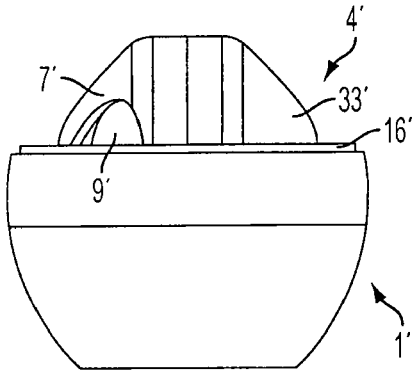
Figure 10C:
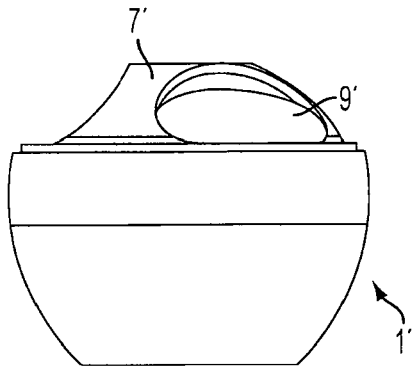
Figure 10D:
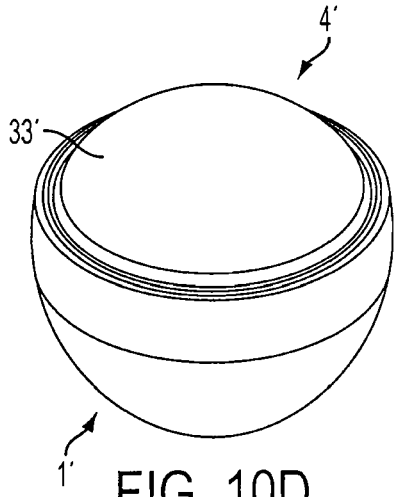
Figure 10E:
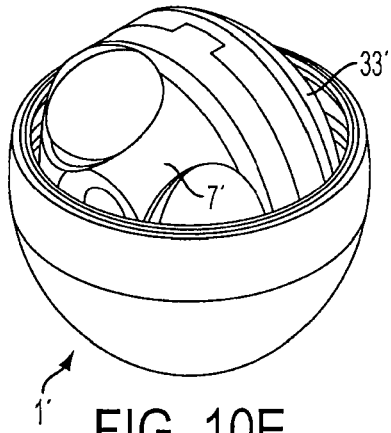
Figure 10F:
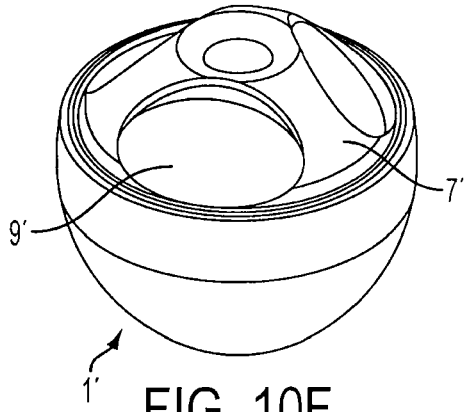
Figure 11A:
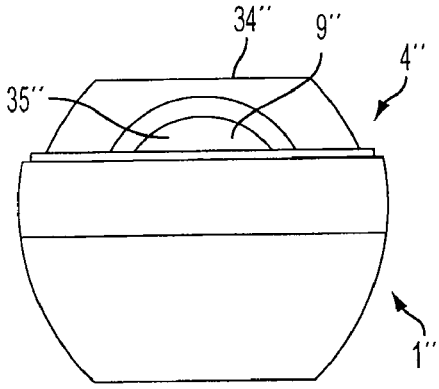
FIGS. 11A to 11C and FIGS. 11D to 11F show another particular embodiment according to the invention in a side view and perspective view, respectively.
Figure 11D:
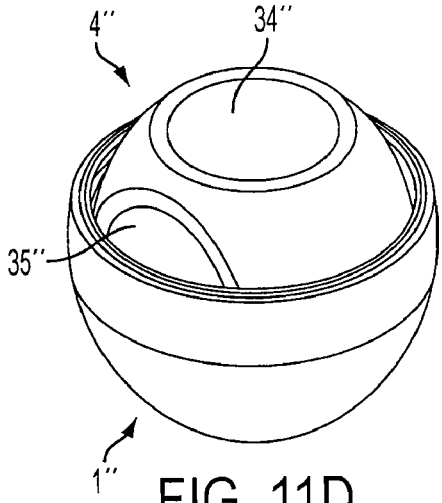
Figure 11B:
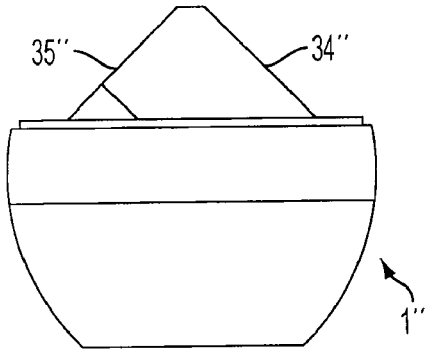
Figure 11E:
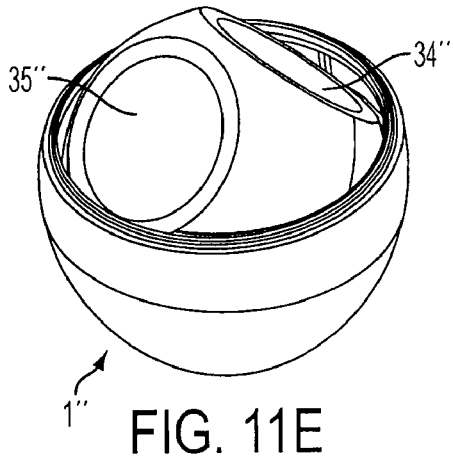
Figure 11C:
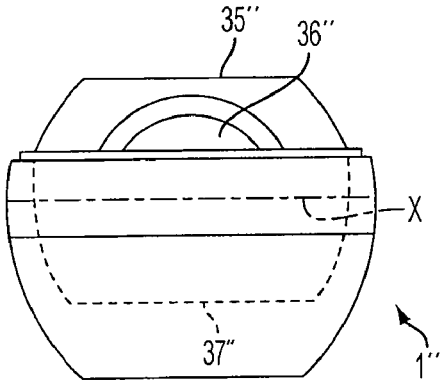
Figure 11F:
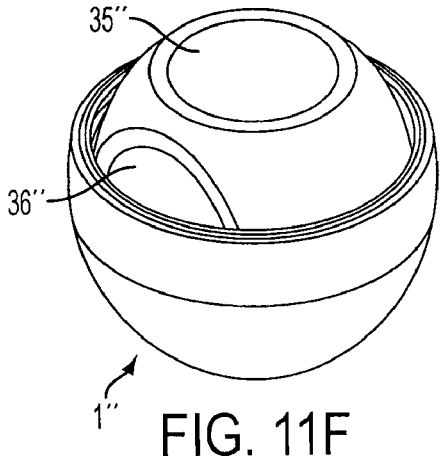
Figure 12A:
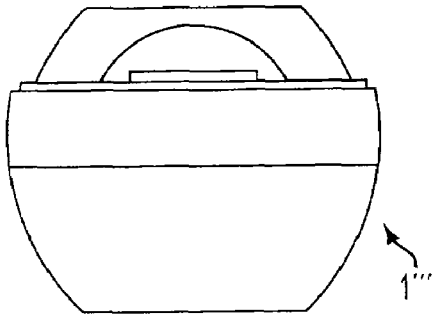
FIGS. 12A to 12C and FIGS. 12D to 12F show another particular embodiment according to the invention in a side view and perspective view, respectively.
Figure 12B:
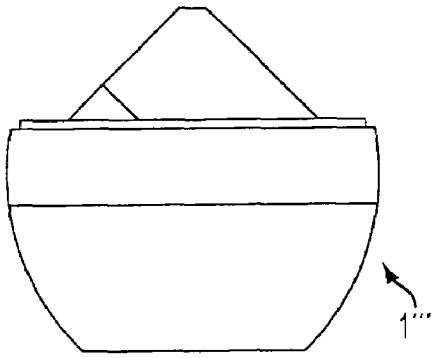
Figure 12C:
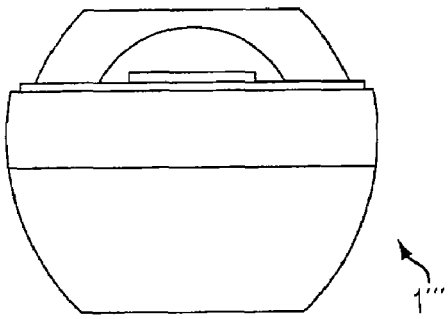
Figure 12D:
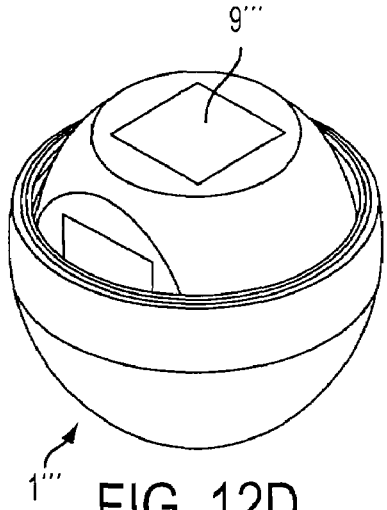
Figure 12E:
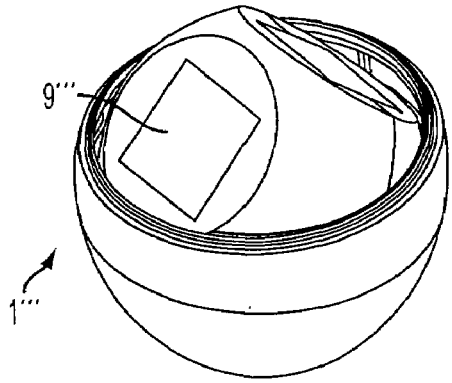
Figure 12F:
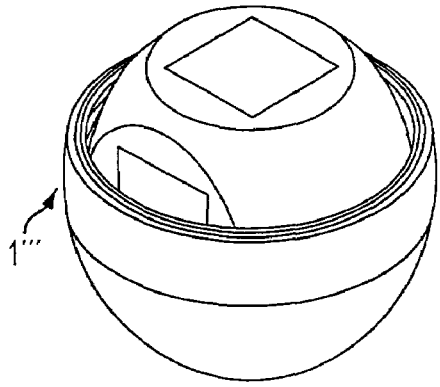

The pinion 17 and the ring 18 of the support are clasped tightly and maintained between the bottom 2 and the flange 3, as shown in FIGS. 8 and 9 which are shown in cross sectional views B-B and C-C respectively in the case 1 in open position, top view of FIG. 7. It is this clasping that enables the support 4 to be maintained inside the hollow base. More particularly, as shown in FIG. 5, the pinion 17 rests on a first rack 20 formed in a first portion 21 of the upper edge of the bottom 2, the teeth 22 of the pinion meshing with the teeth 23 of the first rack 20; and, as shown in FIG. 6, the ring 18 rests, on its external circumference on a first flat surface 24 of a second portion 25 of the upper edge of the bottom 2. Also, as shown in FIG. 8 (and FIG. 1), a second rack 26 formed in a first portion 27 of the interior annular edge of the flange 3 is placed above the pinion 17, the teeth 28 of the second rack 26 meshing with the teeth 22 of the pinion 17; and, as shown in FIG. 9, a second plane surface 29 of a second portion 30 of the interior annular edge of the flange 3 is placed above the ring 18. The first rack 20 extends parallel to the second rack 26 in a plane perpendicular to the Y-axis and the first plane surface 24 extends parallel to the second plane surface 29 in a plane perpendicular to the Y-axis. The pinion is clasped tightly between the first rack 20 and the second rack 26, and the ring 18 is clasped tightly between the first plane surface 24 and the second surface 29 so that, as the bottom 2 is fixed in relation to the flange 3 along the direction of the Y-axis, the X-axis of rotation of the support is fixed in relation to the hollow base along the direction of the Y-axis.

However, when the flange 3 is driven in rotation in relation to the bottom 2 about the Y-axis, the first and second racks 20, 26 are driven in relative opposite directions so that the pinion 17 inserted between these racks 20, 26 is driven with the support 4 in rotation on itself, that is about the X-axis, and in rotation about the Y-axis in relation to the bottom 2 and in relation to the flange 3. The ring 18 is free to move between the first plane part 24 and the second plane part 29 about the X-axis and about the Y-axis.

The support 4 is thus driven in rotation about the X-axis when the flange 3 slides in rotation on the bottom 2. This X-axis is mobile and turns about the Y-axis. In the case 1, meshing occurs with a pinion inserted between two racks. One could also speak of meshing at perpendicular axes but since the radius of the pinion 17 is much less than the radius of the bottom 2 or of the flange 3, the teeth formed on the bottom or the flange are considered to be racks.

The advantage of such a gearing system with a mobile X rotation axis is that it provides better stability to the support when the user presses on the cosmetic products and thus on the support surface to take cosmetic product with the applicator 11.

The racks 20, 26 are advantageously formed on a portion only of the circumference of the bottom 2 and the flange 3 and a stop system limits the rotation of the bottom 2 in relation to the flange 3 so that, for example, the range of movement of the bottom 2 in relation to the flange 3 between a first stop and a second stop corresponds to a 180° turn about the X-axis. Also, the characteristics of the elements of the gearing system are selected in such a manner that the support 4 turns 180° during one rotation of the flange 3 in relation to the bottom between 30° and 100° and preferably during a rotation of 60°.

Obviously, the gearing system can be made in a different manner without departing from the scope of the present application.

Also, the pinion may be driven by only a rack formed on the bottom or on the flange, the element on the bottom or the flange not having a rack cooperating with the support so as to maintain it fixed in rotation in relation to the Y-axis and free in rotation in relation to the X-axis. The support thus turns about an X-axis fixed in relation to an element on the bottom or the flange.

Figure 4:
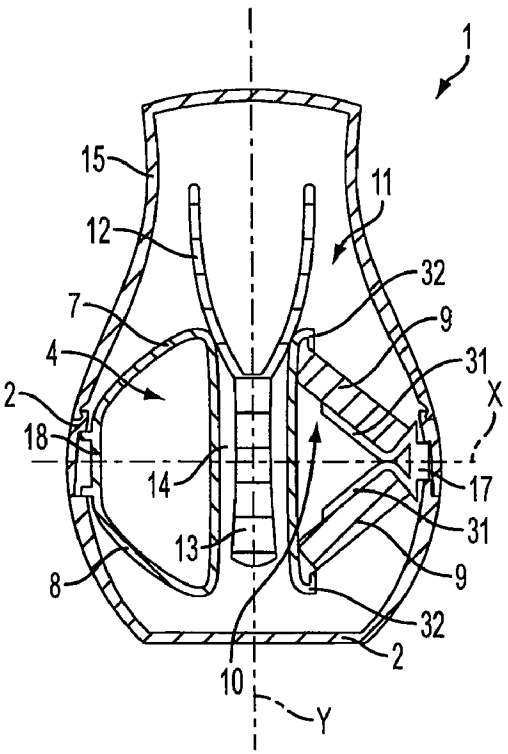
FIG. 4 is a cross sectional view of the case in FIG. 3.

FIG. 4, which is a cross sectional view along A-A of the case 1 in FIG. 3 shows the mounting of the support 4 at the ends according to the X axial direction between the bottom 2 and the flange 3. In closed position, the case presents, through the upper opening, one of the support surfaces, for example the support surface 7, and the recess 14 intended to receive the applicator 11 extends vertically along the Y-axis. This recess 14 preferably passes completely through the support 4, from the centre of one of the support surfaces to the centre of the other support surface. To be stored, the applicator 11 is introduced by the side comprising the application means 13 into the recess 14 and the handle 12 comprises a flared part so as to wedge it at the opening of the recess 14 and so as not to slide into the recess 14. The handle 12 can, for example, be formed by two branches extending in a U-shape, so as to improve how the applicator 11 is held between two fingers. Consequently, the applicator 11 is maintained vertically with the handle 12 in the air, and freely accessible. The applicator 11 is thus easy to grasp and its handle 12 does not run the risk of being dirtied.

The cake cosmetic products 9 can, as shown in FIG. 4, be inserted and maintained between a flexible bottom 31 and a retaining tab 32, rendering them interchangeable. Otherwise, the cosmetic products 9 can be bonded inside compartments 10 or even held by magnetic means.

The case 1 presented can comprise six different cosmetic products, three on each support surface, although this figure can vary according to the number of compartments formed on each support surface, but also according to the number of support surfaces distributed about the rotation axis.

Obviously, the invention extends to all structural modifications of the case presented in reference to the drawings that would be obvious for a person skilled in the art, as for example making use of a support formed from a single part or modifying the shape and/or the number of support surfaces, or even slightly modifying the inclination of the X-axis in relation to the Y-axis, while maintaining the features mentioned in the claims.

According to another particular embodiment of the invention presented in FIGS. 10A to 10F, the support 4' of the case 1' comprises a single support surface 7' supporting for example three cosmetic products 9' and a surface 33' opposite this support surface 7' severing as a cover or lid. It is thus no longer necessary to place a cover 15 on the case and the case 1' shifts from the open position to the closed position by rotation of the support 4' to present either, through the upper opening 16', the support surface 7' supporting cosmetic products 9' or the surface 33' serving as a cover.

According to another particular embodiment of the invention presented in FIGS. 11A to 11F, the support 4" of the case 1" comprises four support surfaces 34", 35", 36", 37" distributed in a regular manner about the X axis of rotation of the support 4". Each of these support surfaces holds for example a unique cosmetic product 10". The support can be successively turned 90° about the X-axis to successively present the various support surfaces 34", 35", 36", 37" and their respective cosmetic product 9". A rotation of 270° about the X-axis enables the four support surfaces 34", 35", 36", 37" to be presented through the upper opening 16".

FIGS. 12A to 12F present a case 1'" essentially similar to case 1" of FIGS. 11A to 11F with cosmetic products 9'" in the form of quadrangular cakes instead of circular cakes.

The invention claimed is:

1. A case for cosmetic products in the form of paste or compact powder cakes, comprising a hollow base having an upper opening defining a plane of the upper opening that extends parallel to the opening, and a support placed inside said hollow base, said support comprising at least one support surface comprising at least one compartment intended to receive a cosmetic product, wherein the hollow base comprises a drive means, wherein the support cooperates in a mobile manner with said hollow base so that the support can be turned inside the hollow base about an X-axis extending parallel to the plane of the upper opening, to present said support surface through the upper opening and that the support is turned by rotation of the drive means about a Y-axis that is perpendicular to the X-axis, where the X-axis is mobile and turns about the Y-axis.

2. The case according to claim 1, comprising at least a first support surface and a second support surface, said first and second support surfaces each comprising at least one compartment designed to receive a cosmetic product, and the support cooperates in a mobile manner with said hollow base so that the support can be turned inside the hollow base to present said first support surface or said second support surface through the upper opening.

3. The case according to claim 1, wherein the support comprises a number n of support surfaces and the support cooperates in a mobile manner with said hollow base so that the support can be turned inside the hollow base to present a single support surface among the n support surfaces through the upper opening.

4. The case according to claim 1, wherein the support comprises a surface serving as a cover and in which the support cooperates in a mobile manner with said hollow base so that the support can be turned inside the hollow base to present a single support surface or said surface serving as a cover through the upper opening.

5. The case according to claim 1, wherein the hollow base further comprises a gripping means, wherein the drive means is mobile in relation to said gripping means, wherein the support is turned inside the hollow base by manual displacement of said drive means in relation to said gripping means.

6. The case according to claim 5, wherein said gripping means, said drive means and said support cooperate by forming a gearing system capable of driving the support in rotation inside the hollow base by manual displacement of said drive means in relation to said gripping means.

7. The case according to claim 6, wherein the gearing system is of rack-and-pinion type.

8. The case according to claim 7, wherein a part of the support forms a pinion, and, a part of the drive means forms a rack and/or a part of the gripping means forms a rack.

9. The case according to claim 5, wherein the X-axis is fixed in relation to said drive means or said gripping means.

10. The case according to claim 5, wherein the X-axis is mobile in relation to said drive means and said gripping means.

11. The case according to any one of claim 5, wherein the gripping means has a circular bowl shape, the drive means has a circular collar shape, and wherein the support is turned by rotation of the drive means in relation to the gripping means.

12. The case according to claim 11, wherein the support turns 180° during a rotation of the drive means in relation to the gripping means between 30° and 100°.

13. The case according to claim 1, wherein at least one support surface comprises a recess intended to receive at least one applicator comprising means for applying cosmetic products on part of the body of the user.

14. The case according to claim 13, wherein the recess extends essentially perpendicularly to at least one support surface.

15. The case according to claim 1, wherein a cover closes said upper opening.

16. The case according to claim 12, wherein the rotation of the drive means in relation to the gripping means is 60°.

* * * * *